US006648500B2

(12) United States Patent
Fedorov et al.

(10) Patent No.: US 6,648,500 B2
(45) Date of Patent: Nov. 18, 2003

(54) ROTARY PULSATION DEVICE

(75) Inventors: Alexander Dmitrievich Fedorov, Kazan (RU); Sergey Germanovich Lebedev, Kazan (RU); Gataullin Rustem Shamgunovich, Kazan (RU); German Alfredovich Volkov, Kazan (RU); Boris Alexandrovich Kesel, Kazan (RU); Dmitry Anatolievich Veselyev, Kazan (RU)

(73) Assignee: International Process Equipment and Technology, Inc., Jackson, ME (US)

( * ) Notice: Subject to any disclaimer, the term of this patent is extended or adjusted under 35 U.S.C. 154(b) by 0 days.

(21) Appl. No.: 09/876,511

(22) Filed: Jun. 7, 2001

(65) Prior Publication Data

US 2002/0085449 A1 Jul. 4, 2002

Related U.S. Application Data

(63) Continuation of application No. 09/284,392, filed as application No. PCT/RU96/00297 on Oct. 14, 1996, now abandoned.

(51) Int. Cl.[7] ..... B01F 7/00; B01F 11/00

(52) U.S. Cl. ..... 366/285; 366/304

(58) Field of Search ..... 366/108, 117–119, 366/124, 168.1, 171.1, 176.1, 176.2, 285, 286, 302–306, 315–317; 241/46.11, 243, 259.1, 260, 261, 261.3

(56) References Cited

U.S. PATENT DOCUMENTS 223,057 A * 12/1879 Mills
1,629,377 A * 5/1927 Buckwalter
2,159,670 A * 5/1939 Neitzke
2,306,857 A * 12/1942 Behnsen
2,339,735 A * 1/1944 Smith
2,591,966 A * 4/1952 Rider
2,627,394 A * 2/1953 Spencer
2,738,931 A * 3/1956 Schneider
2,965,362 A * 12/1960 Flottmann et al.
2,988,290 A * 6/1961 Merges
3,940,115 A * 2/1976 Zipperer
4,092,738 A * 5/1978 Doom ..... 366/304
4,131,061 A * 12/1978 Skeen ..... 241/261
4,431,482 A * 2/1984 Heinbockel et al. ..... 366/304
5,042,726 A * 8/1991 Reinhall ..... 241/261.3
5,088,831 A * 2/1992 Reinhall ..... 366/286
5,450,368 A * 9/1995 Kubota ..... 366/303
5,902,042 A * 5/1999 Imaizumi et al. ..... 366/286
6,354,729 B1 * 3/2002 Brown

FOREIGN PATENT DOCUMENTS

SU 1299615 * 3/1987 ..... 366/304
SU 1706683 * 1/1992 ..... 366/303

* cited by examiner

*Primary Examiner*—Charles E. Cooley
(74) *Attorney, Agent, or Firm*—Woodbridge & Associates, PC; Stuart H. Nissim

(57) ABSTRACT

A rotary pulsation device having a body, at least one rotor and one or more stators, in which the increased efficiency of the device is effected through the presence of ultrasonic vibrations generated by the bulk vibration of the rotors, stators, or both, the generation of the vibrations is a function of a combination of one or more of: the clearance between the rotors and stators which can be adjusted; turbulizing elements on the rotors, stators, or both; incisions on the rotors; slots in the rotors; and choke channels for controlling and directing recirculated flow within the device.

9 Claims, 7 Drawing Sheets

ROTARY PULSATION DEVICE

FIELD OF THE INVENTION

This is a continuation of U.S. Ser. No. 09/284,392, now abandoned, which is a national stage entry of PCT/RU96/00297, filed Oct. 14, 1996.

The present invention relates to mixing equipment for processing mixtures of 110 various substances, primarily flowing liquids, for the purpose of improving the homogeneity of the processed product, more particularly to mixing equipment which incorporates the use of ultrasonic energy to enhance the processing and the usefulness in chemical, food, pharmaceutical and microbiological industries for improved dispersion, homogenization, pasteurization and sterilization.

BACKGROUND OF THE INVENTION

Devices using rotating rotors juxtaposed static stators for mixing liquids is well known in the art.

The device disclosed in USSR Inventor's Certificate No. 1479088 SU, Jul. 28, 1989, consists of a body having internally mounted rotor and stator, with clearance between the rotor and stator and clearance between the stator and the body. The stator is mounted in the body using annular elastic gaskets enabling it to vibrate in the radial direction relative to the axial axis of rotation of the rotor. Both the rotor and stator have turbulizing elements on their opposing surfaces. The device incorporates a mechanism for regulating the axial clearance between the rotor and stator. Flowing liquid media are processed in the device by the action of radial pressure pulsations and circumferential forces of the turbulizing elements. Said force factors are a result of the rotation of the rotor and the vibrations of the stator.

USSR Patent No. 1837953 RU, Nov. 2, 1993 discloses a device containing a body with a central tube for admitting the mixture being processed and an outlet tube for the finished product. Inside the body are a rotor and stator in the form of perforated cylinders concentric relative to one another and to the rotational axis of the device. The device also incorporates an ultrasonic vibration generator attached via an elastic mount to the axis of the inlet tube. The device processes the medium between the rotor and stator with the additional action of ultrasonic vibrations.

The rotary pulsation device disclosed in WO 96/20778 Jul. 11, 1996 (based on PCT/RU95/00061) consists of a body containing a rotor and stator which are mounted with gaps between them in both the radial and axial direction. The rotor and stator both have turbulizers opposing one another. The stator is mounted with an axial clearance relative to the wall of the body and is thereby supported at a point near its center. The stator produces spatial vibrations over a wide range of acoustic frequencies generated under the pressure pulsations and speed of the medium being processed.

An assessment of the technical field shows that potentially beneficial stator vibrations are poorly understood, poorly controlled and largely determined by the stiffness of the stator disk body, the viscosity of the treated medium, and the extent of stator vibration dampening, e.g. due to the presence of the medium being processed in the gap between the stator and the body of the device.

Thus the technical objective of the present invention is to raise the effectiveness of treatment of flowing liquid media of various types and compositions for simultaneous or separate process of, for example, dispersion, homogenization, pasteurization sterilization, and sonochemical reactions using controlled ultrasonic vibrations of the rotor and stator. This results in an unexpected, improvement in efficiency of design and process of the device.

SUMMARY OF THE INVENTION

The technical objective is accomplished by the rotary pulsation device of the present invention which is comprised of a body having an interior in which at least one rotor and one or more stators are mounted so as to permit rotation of the rotor relative to the stators. The rotor and stators are mounted so that they have surfaces which face each other and a clearance between these opposing surfaces. The rotor and stator each have one or more turbulizing elements on their opposing surfaces. Each stator has at least one support point in its central part, preferably located in the area of the rotor's axis of rotation. The stator is mounted such that there is clearance between the stator itself and the body of the device. The device also has a means for adjusting the clearance between the rotor and the stator. The rotor and stator can also include incisions and through slots, preferably between the turbulizing elements and at the outer edge. The incisions, slots, and stator mounting method of the present device enable the rotor and stator to create ultrasonic resonant vibrations; the incisions and slots acting as additional turbulizing elements and means for affecting the rotor's stiffness and the stator mount enabling the stator to execute bulk vibrations with the rotor. The bulk ultrasonic resonant vibrations of the rotor and stator result in an unexpected superior effectiveness of the present device for dispersion and homogenization of the treated liquid medium, increases the effectiveness of pasteurization and sterilization processes, and considerably increases the yield of end products of sonochemical reactions.

BRIEF DESCRIPTION OF THE DRAWINGS

Preferred embodiments according to the present invention will be described in detail with reference to the following figures, wherein.

DETAILED DESCRIPTION OF THE INVENTION

Figure 1:
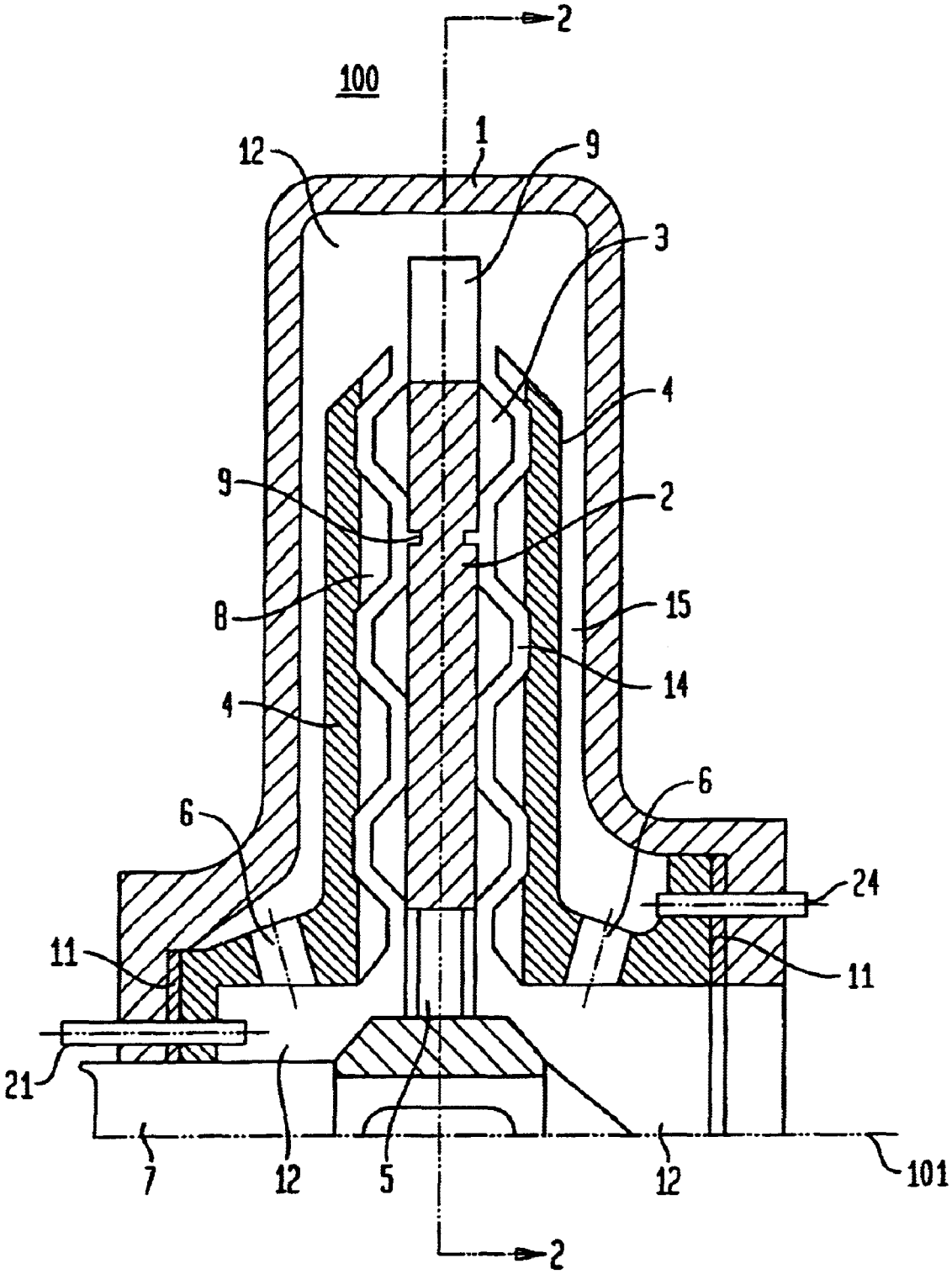
FIG. 1 is an illustration of a cross section of a device of the present invention.
Figure 3:
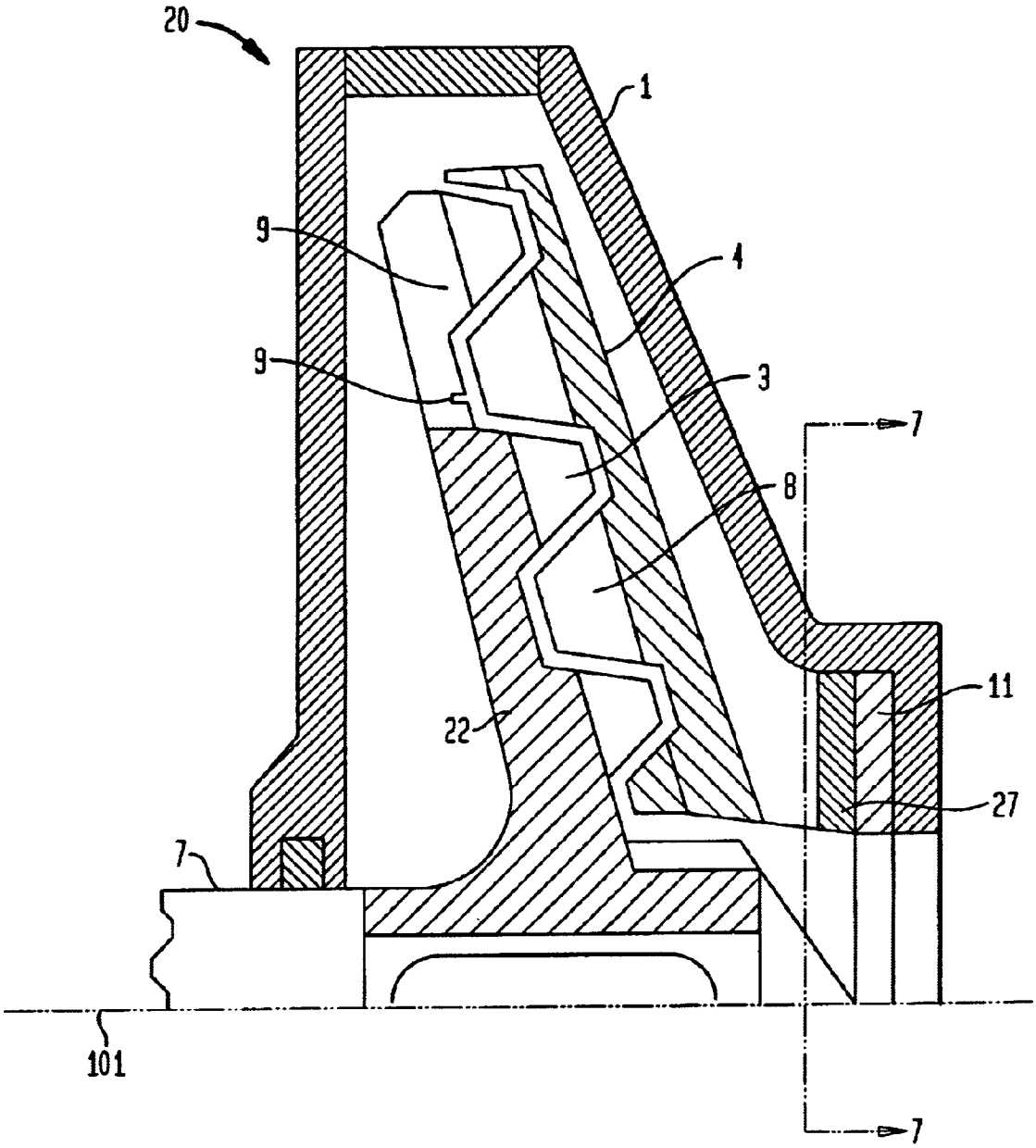
FIG. 3 is an illustration of a cross section of a device incorporating stator and rotor in the form of a frustum of a cone.
Figure 5:
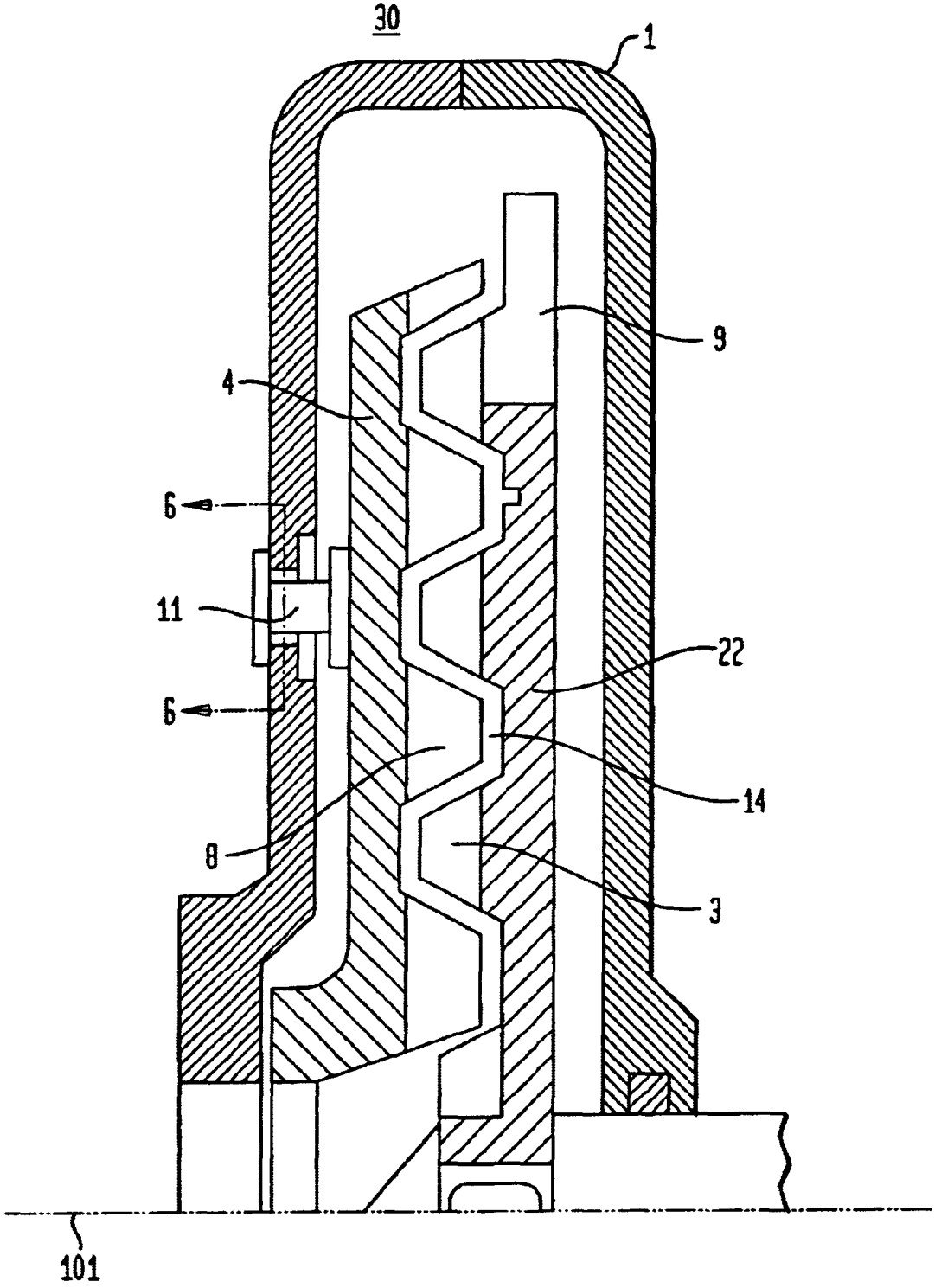
FIG. 5 is an illustration of a device with a one-sided stator and rotor with the stator mounted to the body side wall.

The claimed devices and alternate versions 10, 20, 30 shown in FIGS. 1, 3, and 5 are comprised of a body 1 with at least one inlet tube 21 and at least one outlet tube 24 for feeding and removing products being processed. Inside body 1 are mounted at least one rotor 2, 22 having a central axis of rotation 101 and one or more stators 4. The device 10 may be made with a two-facet rotor 2 with stators opposing each rotor face as shown in FIG. 1, or with a one-facet rotor 22 and stator 20 as shown in FIGS. 3 and 5.

The central, i.e., hub part 27 of the stator may be made in the form of a conical or cylindrical shell, and the peripheral part 29 in the form of a disc or frustum of a cone.

In addition, apertures 6 may be made in the conical or cylindrical shell of the central part 22 of the stator.

To amplify the treatment effect, the stator(s) may be mounted with the possibility of varying the clearance relative to the rotor and/or with the possibility of deviation from alignment of the rotor and stator.

Turbulizing elements 3, 8 with either rectangular or trapezoidal cross sections may be mounted on the opposing surfaces of the rotor and stator(s). Turbulizing elements with trapezoidal cross sections permit a substantial increase in the total area of operating clearances between the rotor and stator while preserving the same number of turbulizing elements compared to turbulizing elements with rectangular cross sections.

Through choke channels or apertures 6 may be made in the central part of the stator hub 27, which enables cyclic treatment of a flowing liquid medium within the device. Moreover, choking of the flowing mechanism using channels and at the inlet or outlet of the device provides various degrees of cyclicity.

The peripheral part 29 of the stator may be made in the form of a disk or frustum of a cone. Such a design permits it to induce forced bulk vibrations by exerting an acoustic effect on the treated flowing liquid medium.

The mounting of two or more stators on one side of the rotor disk means that each of said stators, possessing individual geometric dimensions, also possesses individual acoustic properties. Each of said stators operates most efficiently in its own frequency range and proves effective in its own stage of dispersion. And since the size of the phase particles is not uniform during dispersion, each group of such particles is most strongly affected by a certain stator with certain geometric characteristics. Thus, the spectrum of frequencies emitted by the stator is expanded.

The fabrication of stators with various stiffnesses, and consequently various intrinsic frequencies, is accomplished by manufacturing them of various materials (metals), various disk or cone wall thicknesses, or various coaxial cylinder thicknesses. As in the previous example, this expands the spectrum of frequencies emitted by the stator, which in turn increases the effectiveness of processes such as dispersion.

Mounting the stator(s) with the possibility 11 of varying the clearance between the rotor and stator and the amount of misalignment of the rotor and stator axes permits the selection, or each specific treated medium, of the optimal distances between the rotor and stator, at which the maximum ultrasound acoustic emissions of the vibration system of stator(s) and rotor are achieved, which in turn permits an increase in effectiveness of treatment of the treated medium by the vibration system of stator(s) and rotor, and in a process such as dispersion, produces particles of the dispersed phase with the smallest possible particle diameter for the given system and/or exerts the maximum sterilizing action on the medium.

The rotor may be made in the form of a disk 2, 22 with turbulizing elements 3. Between turbulizing elements 3, the rotor has incisions and/or slots 9 located on the periphery of the rotor and/or along concentric circles.

Figure 2:
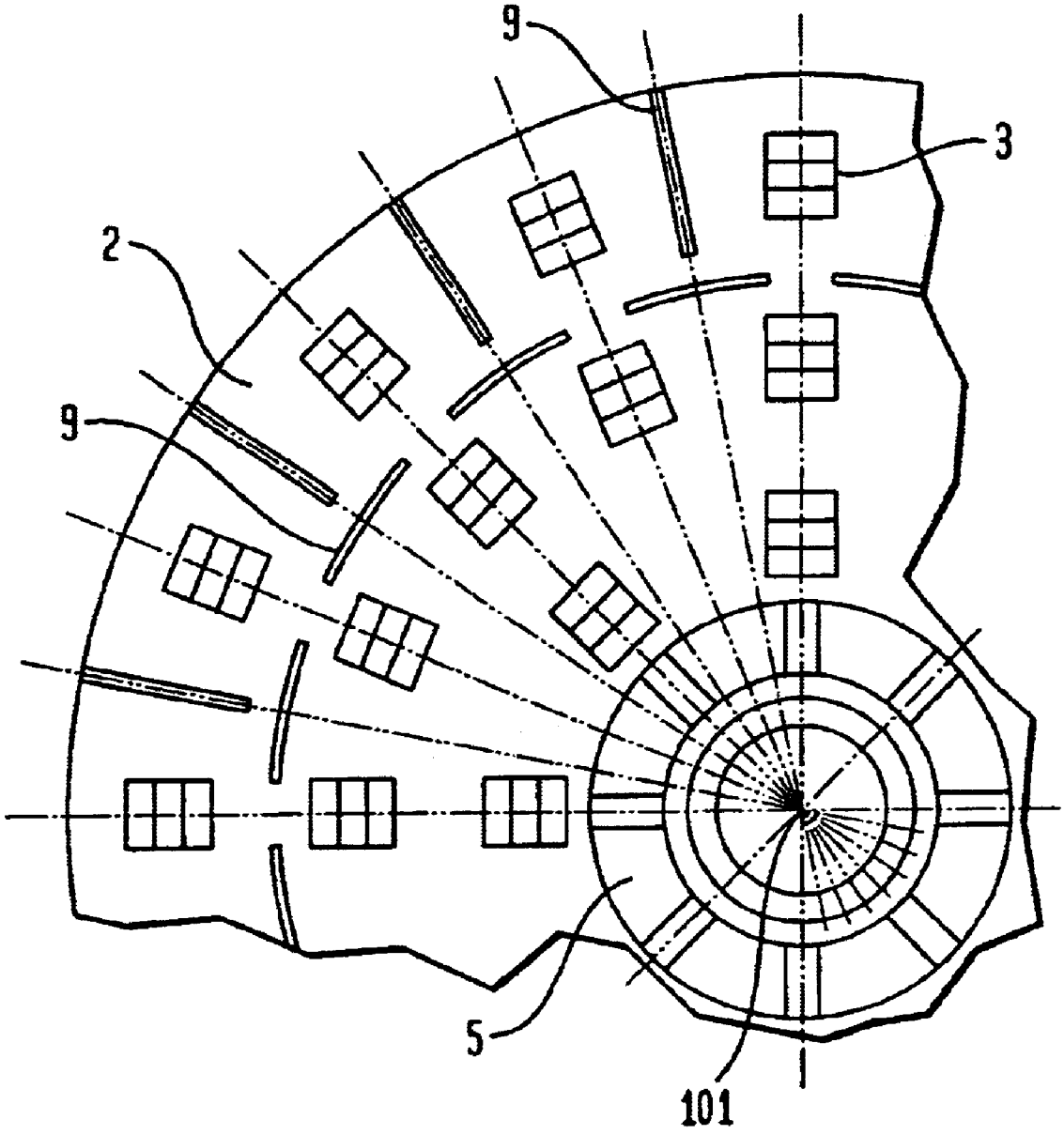
FIG. 2 is a sectional view taken along line 2—2 in FIG. 1 of a rotor disk.

The disk of rotor 2 may also incorporate one or more apertures 5, FIG. 1 and FIG. 2. The apertures 5 permit passage of the medium being processed toward the gap between each rotor-stator pair in the two-facet 22 version of the apparatus.

The rotor is spun using an adjustable drive, such as an electric motor, attached to the rotor shaft 7 which enables selection of the rotor speed that will produce resonance or near-resonance acoustic frequencies in the body, stator, and rotor.

The central part 27 of stator(s) 4 can also have apertures 6, as shown in FIGS. 1, 3, 7 and 8. These apertures 6 are made such that their hydraulic resistance is greater than that of the two rotor-stator channels 14 in the two-facet version of the device. This embodiment prevents unprocessed substances from entering the outlet tube of the apparatus.

Figure 6:
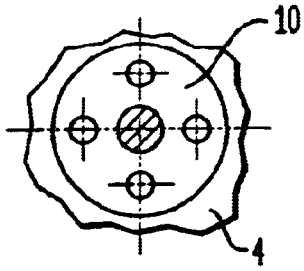
FIG. 6 is a sectional view taken along line 6—6 in FIG. 5 of a stator mount.
Figure 7:
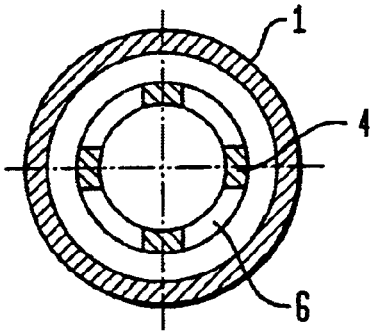
FIG. 7 is a sectional view taken along line 7—7 in FIG. 3 of a device of the present invention.
Figure 8:
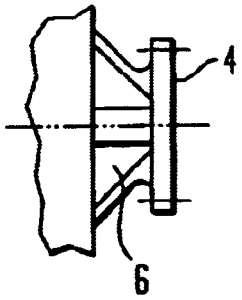
FIG. 8 is an illustration of a cross section of a stator of the invention illustrating the apertures of a device of the present invention.

Stator 4 has turbulizing elements 8 and is located in body 1 with a clearance such that on each side of disk 2 there may be one, two or more stators 4. The central part 27 of stator 4 is mounted to body 1 in the area of the rotor's axis of rotation and has at least one support point 10 (FIG. 5). The attachment of stator(s) 4 to body 1, as shown in FIGS. 5 and 6, permits wide variation of the shape and type of the vibrations of stator(s) 4 during operation. The amplitude characteristics of the vibrations of stator(s) 4 are determined by preliminary calculation.

There is a rotor-stator clearance adjustment means 11. In one embodiment, the device 10, 30 is equipped with a system for the adjustment of the gaps between the rotor 2,22 face and stator 4 face by variation of the thickness of spacers 11. This passive gap regulation system is designed to compensate for the wear of turbulizers 3,8 and to ensure superfine processing of the medium at minimal gap sizes, if required by quality conditions imposed on the output product.

The device operates as follows.

The flowing liquid medium being processed passes through inlet tube 21 of the claimed device into a channel 15*a* formed by the hub of stator 4 and the shaft 7 of rotor 3. Then part of the medium passes through apertures 5 into the cavity 15*b* between shaft 7 and the hub 27 of stator 4.

Acted upon by centrifugal forces created by the rotation of rotor 3, the medium being processed enters the device's work zone, 12 formed by rotor 3 and stator 4.

Figure 4:
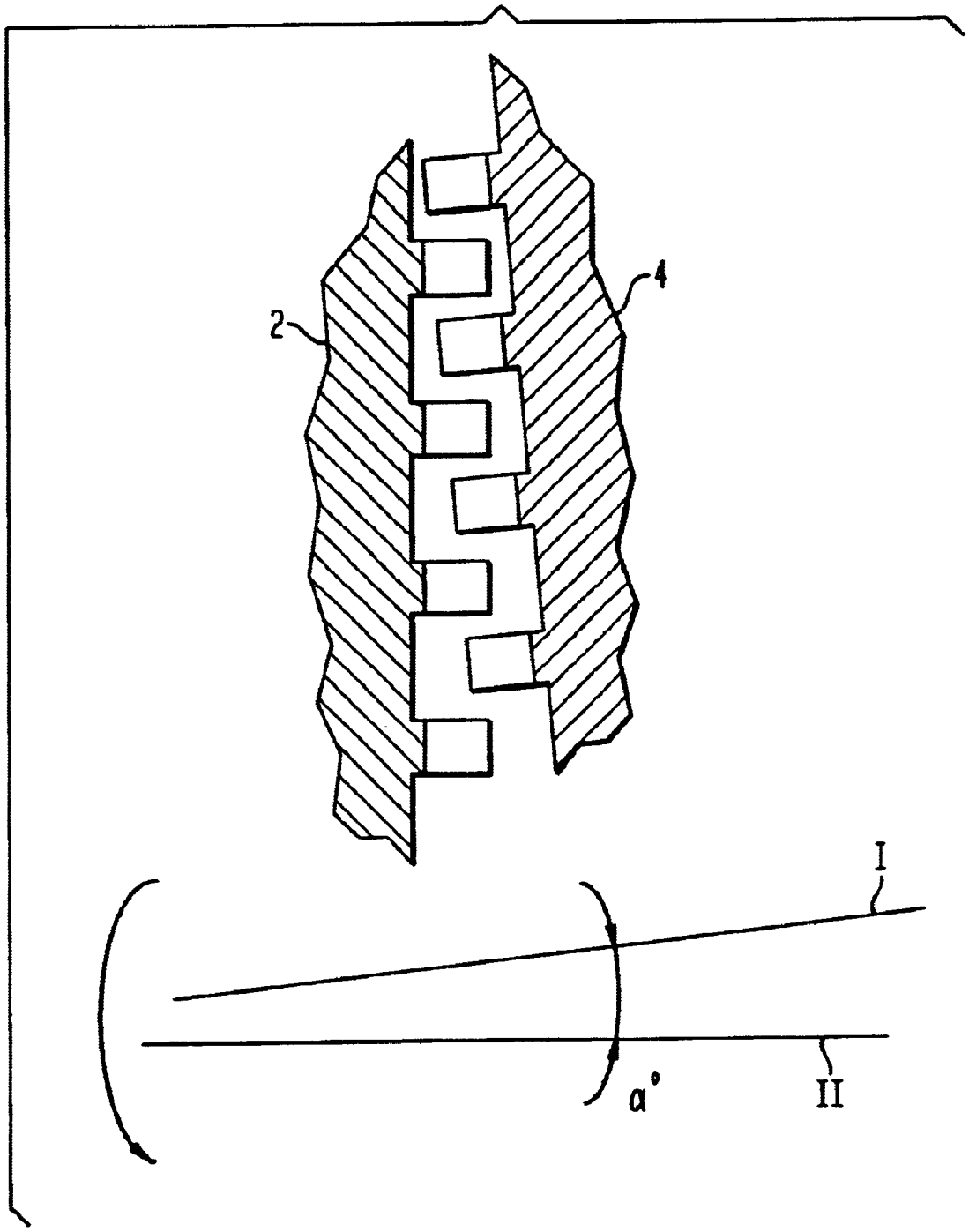
FIG. 4 is an illustration of a rotor and stator mounted with axial misalignment.

Moving in the channels 14 between the rotor 2 and stators 4, the flowing liquid medium being processed is subjected to combined action in the form of a broad-band pulsed pressure front, cavitation, and ultrasonic vibrations. The guaranteed conditions for the production of ultrasonic vibrations are provided by a special (eccentric) mount for the device's stator(s) relative to the axis of the device's rotor, as shown in FIG. 4. Additional factors which contribute to the production of ultrasonic vibrations are the operation of apertures 6 in stators 4, which because of their hydraulic resistance, regulate the level of the medium being processed in the space 15 between the stators 4 and the walls of body 1, thereby creating variable conditions for stator vibration damping or amplification according to the physical chemical properties of the medium being processed and the purposes of its processing.

At the same time, part of the flowing liquid medium in the gaps 15 between stators 4 and the walls of body 1 are further processed in the channels 14 between stator 4 and rotor 3 due to the gradual outflow through apertures 6.

The ultrasound acoustic effect of the rotor-stator vibration system on the medium is more powerful for the present device due to differences in the rotor design and the very intense mixing of the medium being processed in the zone(s) exposed to the acoustic effect.

In a preferred rotor there are a plurality of grooves and/or through slots 9 between the turbulizers 3 which can be located on the periphery of the rotor 2, 22 and along concentric circles on the rotor's face(s). The incorporation of grooves and through slots permit production of active rotor components with various intrinsic vibration frequencies expanding the spectrum of resonance frequencies of the rotor as a whole.

The device may be equipped with at least one additional stator mounted coaxially to the existing stator on the same side of the rotor, and the stators may be made with matching or non-matching intrinsic frequencies.

The device may also be fitted with at least one additional stator mounted on the other side of the rotor and may be made with matching or non-matching intrinsic frequencies.

Figure 9:
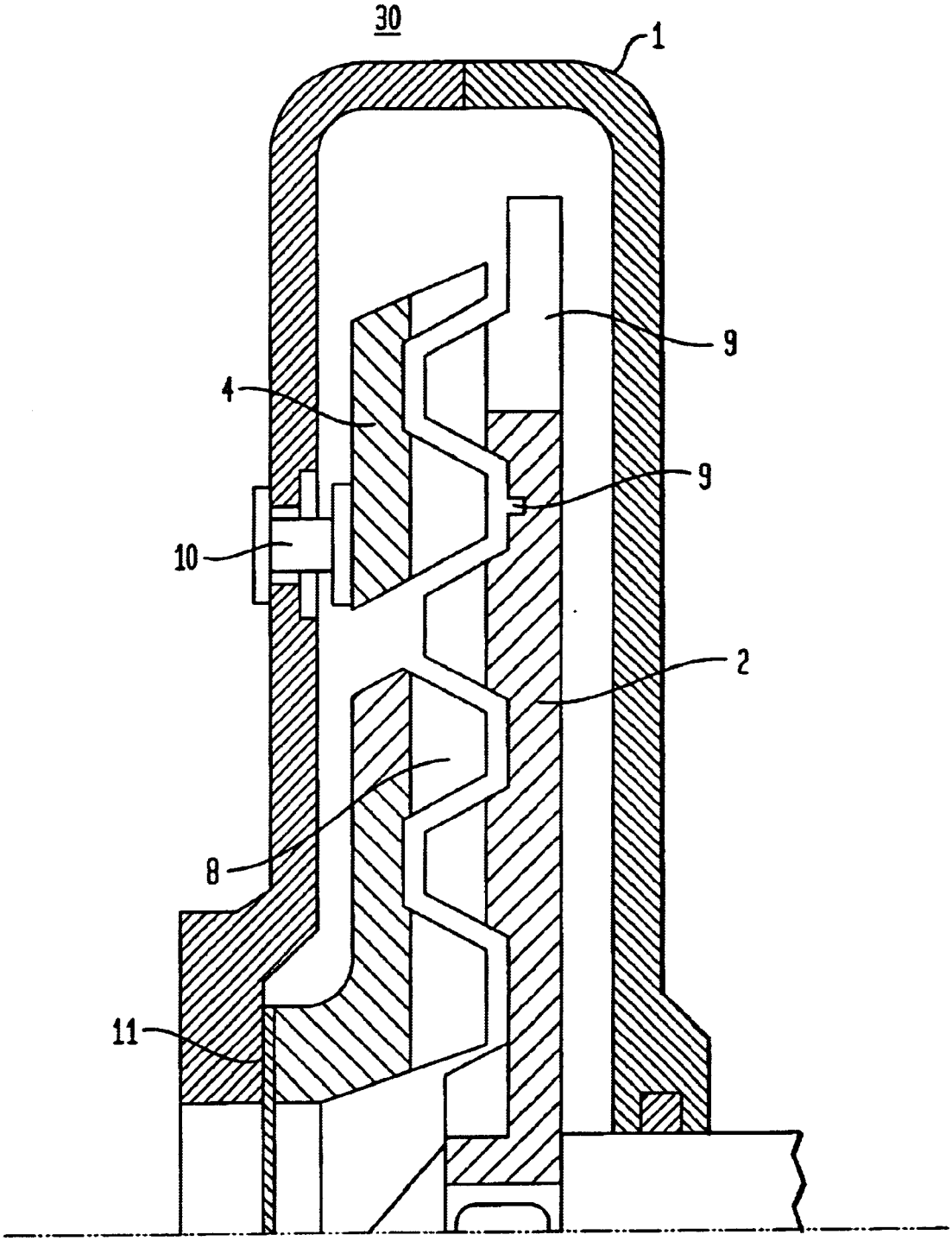
FIG. 9 is an illustration of a cross section of a device incorporating 2 stators.

In another embodiment two or more stators 4, 4*a* (FIG. 9) are used on the same side of the rotor disk, and that each of them can have different dimensions (a stator 4*a* located near the rotor's axis of rotation is smaller than a stator located at a large diameter), permitting the user to obtain each stator's own intrinsic resonance vibration frequency. Stators with smaller dimensions will have higher intrinsic vibration frequencies than stators with larger dimensions. In this embodiment, each device has two or more stators that each operate individually most efficiently in their own rotor speed range. In addition, the grooves and/or slots 9 on the rotor 2, 22 enable construction of rotors with various intrinsic vibration frequencies. Thus, the device with two or more stators located on the same side of the rotor disk, has a rotor-stator system with a wider range of intrinsic vibration frequencies.

Making stators of different elasticities, i.e., of various materials with various moduli of elasticity, and also with various disk designs and shapes, also expands the spectrum of intrinsic vibration frequencies of the rotor-stator system, which makes the device more universal and enables it to process a wide range of various flowing liquid media possessing various physical properties (viscosity, interphase surface tension, sound propagation rate in the system, dissipation of acoustic vibrations).

Using the adjustable speed drive, the most efficient rotor speed can be selected to create the most intensive dispersion, and/or sterilization, and/or mixing, or a combination of these and other processes occurring in the media being processed, depending on the desired objective.

In yet another embodiment mounting multiple stators on both sides of the rotor disk both increases process efficiency by increasing throughput and also expands the range of the initial stage of breakaway acoustic cavitation because the stators located on different sides of the rotor disk directly affect one another through the flowing liquid medium being processed. Mounting the stator(s) in the body with the ability to change the distance between it and the rotor and with the ability to misalign their axes increases the effect of the rotating rotor on the stator(s). Reducing the gap or distance between the rotor and stator, beside intensifying the processing of the flowing liquid medium, also increases the heat released into the fluid, and sharply increases the temperature of the medium being processed. So, for each specific flowing liquid medium processed, the rotor-stator clearance is selected so that high temperature does not cause changes in the liquid medium that would have adverse effects. In contrast, misaligning the stators and the rotor increases the effect of the rotating rotor on the stator(s), since any increase in the irregularity of the gap between the rotor and stator will increase the resulting effect of the rotor on the stator, which will in turn intensify the acoustic processes in the rotor-stator system—this also intensifies the processes occurring in the medium being processed. Thus, the claimed device considerably intensifies the processes of dispersion, homogenization, mixing, and dissolution, and enables sonochemical (acoustic chemical) reactions and/or the aforementioned processes of pasteurization or sterilization of flowing liquid media.

Active mixing, combined with intense ultrasound acoustic treatment, produces favorable conditions during dispersion of solutions, for example, hydrophobic colorants, during homogenization of milk and milk products, preparation of and ultrafine emulsions and dispersions. The two aforementioned factors also have a favorable effect in pasteurization and sterilization processes, since they permit the entire treated medium to be subjected uniformly to intense acoustic effects that destroy bacteria and microorganisms.

The adjustable drive permits selection of the rotor speed that produces near resonant or resonant acoustic vibration frequencies in the body, stator and rotor. The mounting of two or more stators on one side of the rotor disk, because each has different dimensions (the stator located closer to the rotor axis is smaller than the stator located at a larger diameter), enables each of them to produce its own intrinsic resonance vibration frequency. Stators with smaller dimensions will have higher intrinsic vibration frequencies than stators with larger dimensions. In this case, the device has two or more stators, each of which separately operates most effectively in its own intrinsic rotor speed range. In addition, the incisions and/or slots on the rotor permit production of rotors having various intrinsic vibration frequencies. Thus, the device under discussion, with two or more stators located on one side of the rotor disk, has a rotor-stator system with a wider spectrum of intrinsic vibration frequencies. Making stators with various stiffnesses, i.e., of various materials possessing various moduli of elasticity, and with various disk designs and shapes, also expands the spectrum of intrinsic vibration frequencies of the rotor-stator system, which makes this device more universal and permits its use for treatment of a wide range of various flowing liquid media possessing various physical properties both originally and during treatment (viscosity, interphase surface tension, sound propagation rate in the system, dissipation of acoustic vibrations in the system, etc.). By using the adjustable drive at the acoustic vibration maximum, the most effective rotor speed can be selected, at which, depending on the objective to be accomplished, the most intense dispersion and/or sterilization, and/or mixing, or a combination of these and other processes occurring in the treated media occurs. The mounting of stators on both sides of the rotor disk permits both an increase in process efficiency through increased throughput and an expansion of the range of initial stage of breakaway acoustic cavitation because the stators located on opposite sides of the rotor disk exert a direct effect on one another through the flowing liquid medium being treated. The mounting of a stator or stators in the body with the possibility of varying the distance between them and the rotor and with the possibility of deviation from alignment between them enhances the effect of the rotating rotor on the stator(s). Reducing the clearance (distance) between the rotor and stator besides amplifying the effect of treatment of the flowing liquid medium, also increases heat released into the liquid and sharply increases the temperature of the treated medium. Therefore, for each specific flowing liquid medium treated, the clearance between the rotor and stator (s) is selected such that the high temperature does not produce changes in the liquid medium with negative consequences. The misalignment between the stator(s) and the rotor disk, on the other hand, intensifies the effect on the part of the rotating rotor on the stator(s), since any amplification or increase in the irregularity of the gap between the rotor and stator amplifies the resulting effect on the part of the rotor on the stator, which in turn intensifies the acoustic processes in the rotor and stator system. This also intensifies the processes occurring in the treated medium. Thus, the claimed device enables considerable intensification of the processes of dispersion, homogenization, mixing, dissolution, and permits sonochemical reactions and/or the aforementioned processes to be performed in combination with high-performance pasteurization or sterilization.

What is claimed is:

1. A rotary pulsation device comprising:

a body;

one or more stators having a bushing and a disk, said disk having a face with a plurality of turbulizing elements and mounted to said body with spacing between said one or more stators and said body, whereby said one or more stators can vibrate, independently of each other, at ultrasonic frequencies;

a rotor having a disk and having a central axis of rotation which is perpendicular to the plane of said disk, said disk being rotatable relative to said one or more stators and said body and having at least one face with a plurality of turbulizing elements arranged in concentric circles relative to said rotor's axis of rotation;

a shaft attached coaxially to said rotor;

a rotation means attached to said shaft for rotating said rotor at varying speeds; and, an adjusting means for adjusting the relative distance between said one or more stators and said rotor comprising a spacer or spacers between said body and said one or more stators; wherein the disk face of said one or more stators is opposing said at least one face with turbulizing elements of said rotor;

wherein adjusting the distance between said rotor and said one or more stators with said adjusting means varies the relative distance between the turbulizing elements on said rotor and the turbulizing elements on said one or more stators.

2. The rotary pulsation device of claim 1 wherein said rotor has a plurality of through slots, grooves, or a combination thereof arranged circumferentially, radially or both on said at least one face of said rotor.

3. The rotary pulsation device of claim 1 wherein said turbulizing elements on said rotor and said one or more stators are trapezoidal in shape.

4. The rotary pulsation device of claim 1 wherein said adjusting means can also vary the alignment of said rotor with said one or more stators.

5. The rotary pulsation device of claim 1 comprising two or more stators.

6. The rotary pulsation device of claim 5 wherein said rotor having two of said at least one faces, and wherein said two or more stators are located coaxially relative to each other and where at least one or more of said two or more stators is located opposite each of said two faces of said rotor.

7. The rotary pulsation device of claim 5 wherein said two or more stators have, independently of each other, various stiffnesses.

8. The rotary pulsation device of claim 1, further comprising a plurality of apertures in the bushing of said one or more stators arranged circumferentially.

9. A rotary pulsation device comprising:

a body;

two or more stators having a bushing and a disk, said disk having a face with a plurality of turbulizing elements;

a rotor having a disk and having a central axis of rotation which is perpendicular to the plane of said disk, said disk being rotatable relative to said two or more stators and said body and having at least one face with a plurality of turbulizing elements arranged in concentric circles relative to said rotor's axis of rotation;

a shaft attached coaxially to said rotor;

a rotation means attached to said shaft for rotating said rotor at varying speeds; and, an adjusting means for adjusting the relative distance between said two or more stators and said rotor;

wherein the disk face of said two or more stators is opposing said at least one face with turbulizing elements of said rotor;

wherein said two or more stators are located coaxially relative to each other and opposite the same at least one face of said rotor.

* * * * *